US006499514B1

(12) United States Patent
Hodge, Sr.

(10) Patent No.: US 6,499,514 B1
(45) Date of Patent: Dec. 31, 2002

(54) FENCING CLIP AND TOOL

(76) Inventor: Rickey E. Hodge, Sr., P.O. Box 245, Bentley, KS (US) 67016

( * ) Notice: Subject to any disclaimer, the term of this patent is extended or adjusted under 35 U.S.C. 154(b) by 0 days.

(21) Appl. No.: 09/860,858

(22) Filed: May 18, 2001

(51) Int. Cl.[7] ..... B21F 15/04
(52) U.S. Cl. ..... 140/57; 140/52; 256/57
(58) Field of Search ..... 140/11, 49, 51, 140/52, 56, 57; 256/57

(56) References Cited

U.S. PATENT DOCUMENTS 1,510,686 A * 10/1924 Knopke ..... 256/57
1,791,692 A * 2/1931 Swenson ..... 256/57
1,814,228 A * 7/1931 Peters ..... 256/57
1,848,515 A * 3/1932 Davidson ..... 256/57
3,031,170 A * 4/1962 Ingram ..... 256/57
5,649,572 A 7/1997 Lile
5,909,910 A 6/1999 Shaffer

* cited by examiner

*Primary Examiner*—Lowell A. Larson
(74) *Attorney, Agent, or Firm*—Fellers, Snider, Blankenship, Bailey & Tippens, P.C.

(57) ABSTRACT

A clip for securing a fence wire to a post and a tool for using the clip. The clip is formed from a piece of wire having: The tool includes: two prongs spaced apart for each other a distance roughly equal to the distance between the outer bends of the clip. In use, an aperture is formed by the interaction between the clip and a fence wire. The prongs are inserted through the apertures so formed and rotated to cause the outer portions of the clip to wrap around the fence wire.

4 Claims, 5 Drawing Sheets

20
22
24
25
26
27
28
30
31
32
34
36
38
40
42
44a
44b
46a
46b

FENCING CLIP AND TOOL

BACKGROUND OF THE INVENTION

1. Field of the Invention:

This invention relates generally to a clip for securing fencing material to a fence post and a tool for attaching the clip. More particularly, but not by way of limitation, the present invention relates to a clip for securing fencing material to a T-post and a tool for wrapping the ends of the clip around the fencing material.

2. Background:

In fencing an area, typically a fence row is cleared, posts are set on regular intervals along the fence row, fencing material is placed along the posts, the material is stretched, and finally, the fencing material is secured to the posts. T-posts are often used to support fencing material, particularly in an agricultural setting. When T-posts are used, the most common method of securing the fencing material to the T-post is with a wire clip. The clip loops behind the T-post, opposite the fencing material, and each end of the clip wraps around a horizontal wire of the fence on opposite sides of the post to secure the wire to the post. Traditionally, T-posts are supplied with such clips. This method of fencing is well known in the art.

After a fence is in place, any number of environmental factors may damage a fence to the point of requiring the performance of one or more of the steps discussed above to mend the fence. Examples of such factors include: damage from livestock; damage from broken tree limbs; vandalism; weather related damage; and the like. Fence repairs often require the removal and replacement of the T-post clips.

While clips have long been used to secure fencing to posts, they have consistently suffered from a number of limitations. As provided, clips are pre-bent to hook the wire on one side of the post and wrap behind the post. The other end of the clip must then be wrapped around the wire using fencing pliers, slip-joint pliers, or the like. Finally, the first end is then wrapped around the wire so that both ends are secure. This process is historically cumbersome, time consuming, and frustrating. As formed, the clips are best bent using a plier like tool, unfortunately, such a tool is just not well suited to the task.

A number of prior art tools have been developed to simply the wrapping operation. For example, U.S. Pat No. 5,649,572 issued to Lile discloses a plier-like tool for wrapping the ends of a conventional fencing clip around a fence wire, one end at-a-time. It should be noted that, to secure the clip, the tool must be rotated under the wire being secured and, therefore, this tool only simplifies the securing operation for fencing of individual wires, i.e., barbed wire, and requires a spacing between the wires sufficient to clear the tool. The tool is not usable with wire mesh fencing.

U.S. Pat No. 5,909,910 discloses a bar-like tool for bending a fence clip around a fence wire. Again, to perform the operation, the tool must pass between individual fence wires limiting its application to fencing made of strands of wire. In addition, the bar will only bend one end of the clip. As a result, the other end of the clip is either left merely hooked and not wrapped, or pliers must be used to bend the opposite end.

Thus it is an object of the present invention to provide a fencing clip and a tool for using the same which is easy to use, quick to attach, and provides an attachment equal to or better than a conventional clip.

SUMMARY OF THE INVENTION

The present invention provides a fencing clip and a fencing tool for use in securing a fence wire to a fence post. The inventive system is particularly useful with T-posts which are well known for fencing, particularly in an agricultural setting. The inventive clip is suitable for use with all known wire fencing materials such as, by way of example and not limitation: wire; barbed wire; welded wire; field fence; horse fence; rabbit wire; chicken wire; chain link; etc.

In a preferred embodiment, the clip is preformed such that, with the fencing material stretched and in place against the post, the clip may be placed from behind the post with the bent ends of the clip resting over the fence wire. With the clip in this position, apertures are formed by the interaction between the bent portions of the clip which extend below the fence wire and the fence wire. The inventive tool is inserted through the apertures from behind the wire such that when the tool is then rotated downward, both ends of the clip are simultaneously wrapped around the fence wire to secure the fence to the post. Thus, the problems associated with using pliers to wrap the clip around the fence are overcome.

The inventive tool comprises two prongs extending from a handle. The ends of the prongs are spaced to match the distance between the bent ends of the clip. The prongs are set in an angular position relative to the handle such that, when the prongs are inserted through the apertures formed between the clip and the wire, the fence post and the fencing will not interfere with the operation of the tool.

Further objects, features, and advantages of the present invention will be apparent to those skilled in the art upon examining the accompanying drawings and upon reading the following description of the preferred embodiments.

DETAILED DESCRIPTION OF THE PREFERRED EMBODIMENT

Before explaining the present invention in detail, it is important to understand that the invention is not limited in its application to the details of the construction illustrated and the steps described herein. The invention is capable of other embodiments and of being practiced or carried out in a variety of ways. It is to be understood that the phraseology and terminology employed herein is for the purpose of description and not of limitation.

Figures 1, 2, 3, 4, 5:
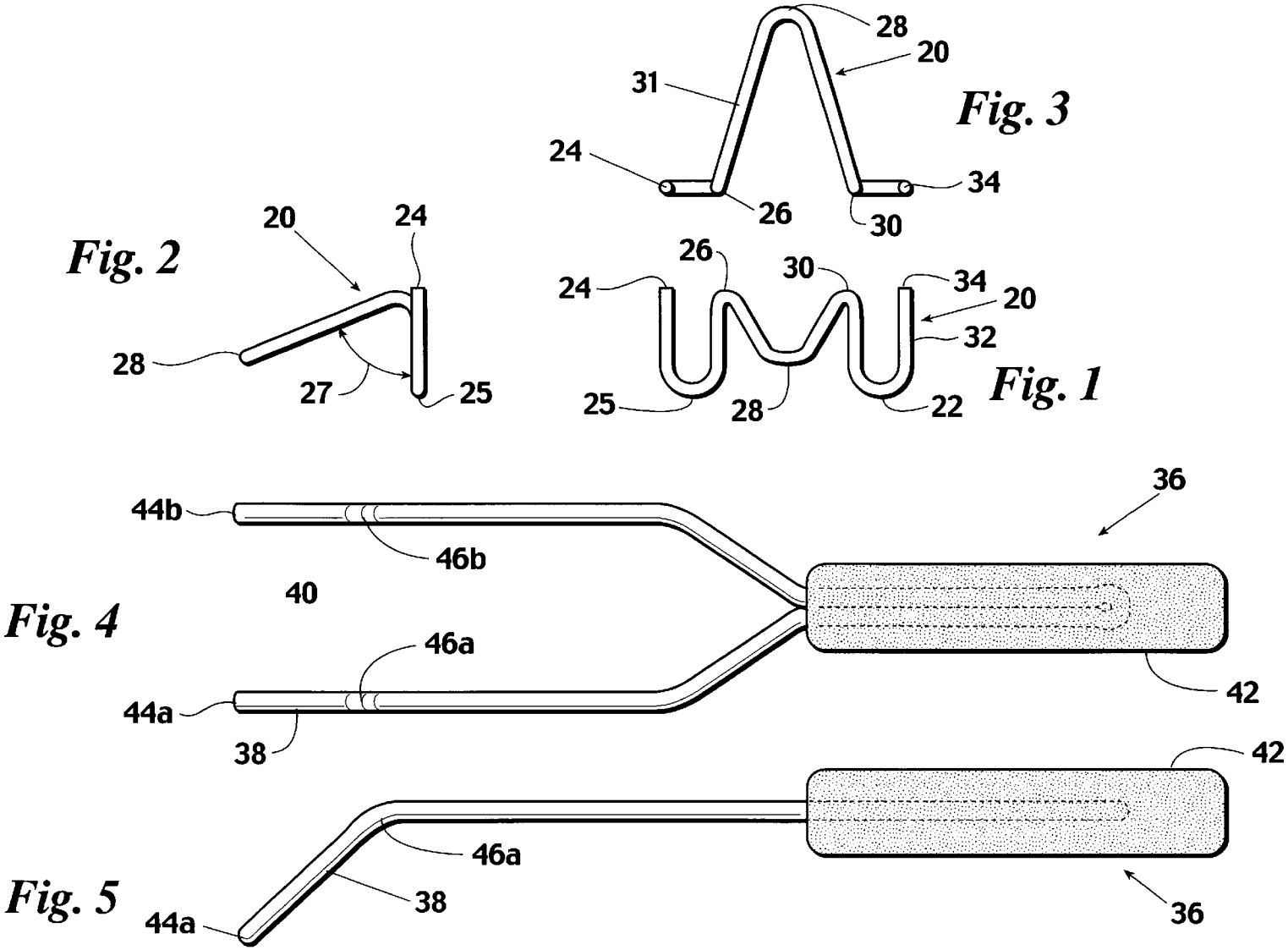
FIG. 1 provides a front plan view of the inventive clip.
FIG. 2 provides a side plan view of the inventive clip.
FIG. 3 provides a top plan view of the inventive clip.
FIG. 4 provides a top plan view of a fencing tool for use with the inventive clip.
FIG. 5 provides a side view of the fencing tool.

Referring now to the drawings, wherein like reference numerals indicate the same parts throughout the several views, a preferred embodiment of the inventive clip 20 is shown in FIGS. 1–3. Preferably, clip 20 is formed from a single piece of wire 22, or other similar ductile material, having: starting at a first end 24 of wire 22, a first bend forming a first, generally U-shaped section 25; a second bend 26, a third bend 28, and a fourth bend 30 forming a forward facing concave section 31; and a fifth bend forming a second, generally U-shaped section 32 near the second end 34 of wire 22. As best seen in FIG. 2, preferably an acute angle 27 is formed between section 31 and U-shaped sections 25 and 32, as formed by bends 26 and 30, respectively. This angle is preferably in the range of 45 degrees to 90 degrees, however, the key features of this angle are: a) when clip 20 is placed over a fence wire 50 as shown in FIGS. 6 and 7, the angle is sufficient to allow clip 20 to rest in place on wire 50 and retain wire 50 against post 48, even when there is some force urging wire 50 away from post 48; and b) the angle is proper to allow the insertion of tool 36 through bends 25 and 31, as shown in FIG. 8, from the front of post 48.

Referring again to FIGS. 1–3, it can thus be seen that U-shaped bends 25 and 31 lie generally in a first plane, concave section 31 lies generally in a second plane, and the angle 27 between the first plane and the second plane is defined by bends 26 and 30 which are preferably acute.

Referring next to FIGS. 4 and 5, tool 36 includes: a first prong 38; a second prong 40 and a handle 42. Prongs 38 and 40 are bent to achieve a spacing at distal ends 44*a* and 44*b* of roughly the same width as the centers of U-shaped sections 25 (FIG. 1) and 32 of clip 20. Prongs 38 and 40 are also bent at points 46*a* and 46*b*, relative to handle 42 to provide clearance during the securing operation as will be discussed herein below.

Figure 7:
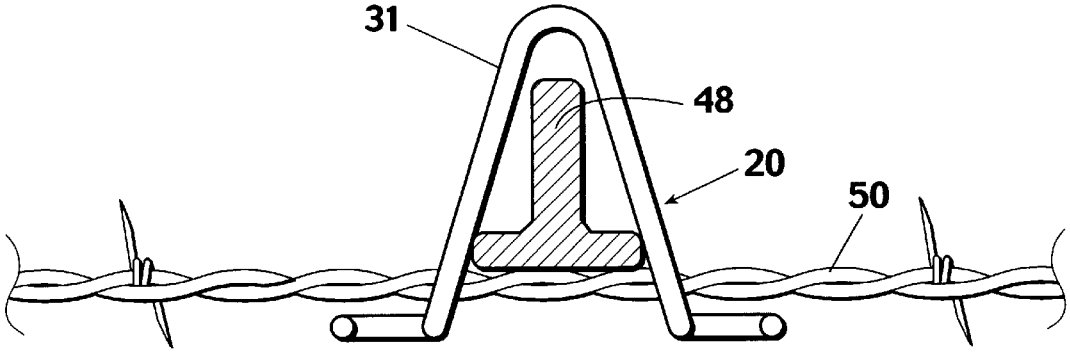
FIG. 7 provides a top view of the clip, T-post, and fence wire as seen from perspective 7—7 of FIG. 6.
Figure 6:
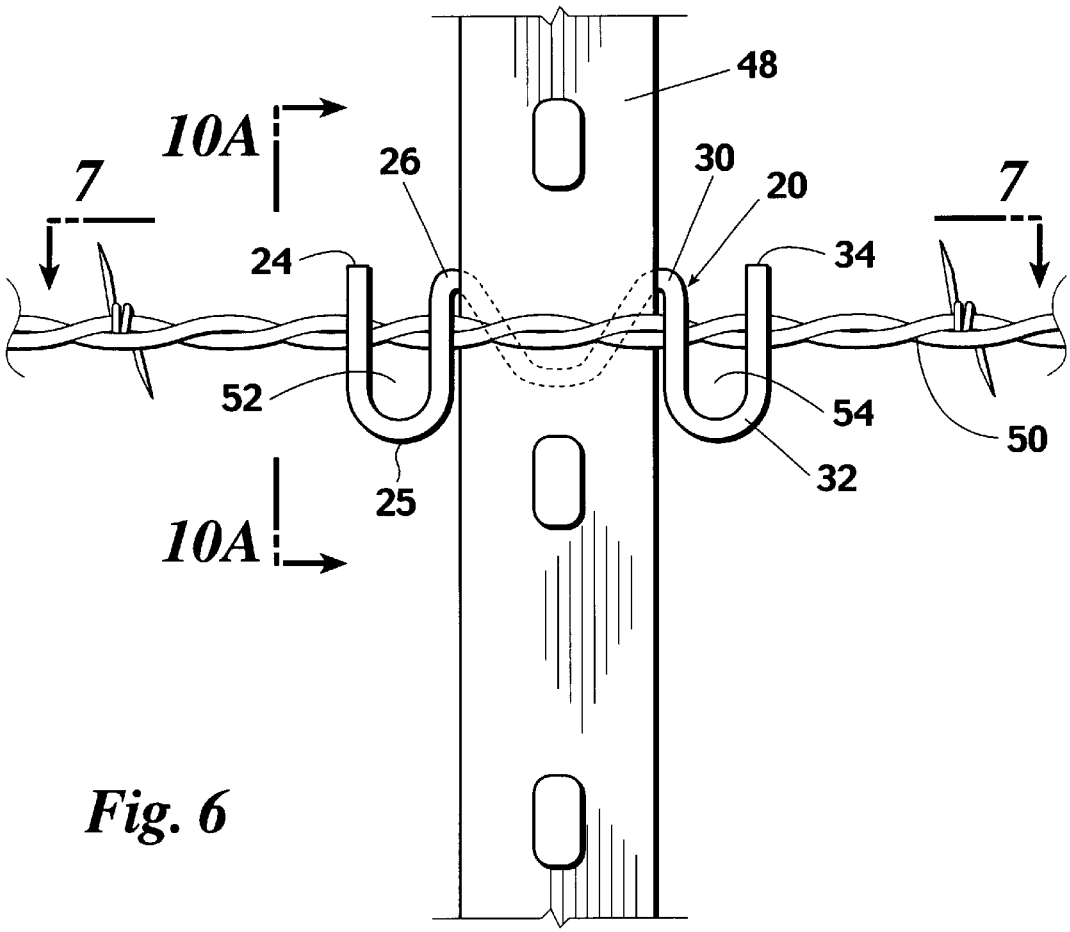
FIG. 6 provides a front view of a clip, T-post, and fence wire prior to securing the wire to the post.
Figure 8:
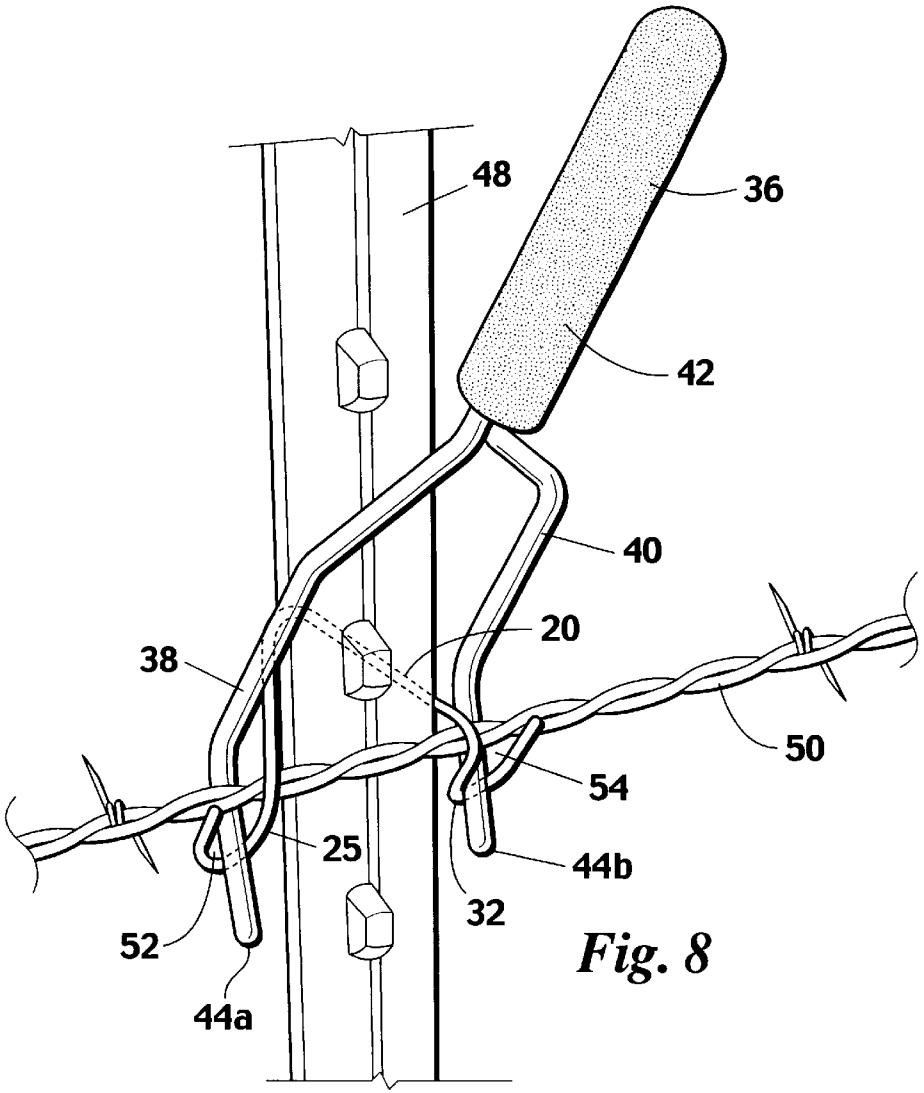
FIG. 8 provides a perspective view showing the tool inserted into the clip in an initial position.

Referring next to FIG. 6, after the fence wire 50 is stretched into place, a clip 20 is placed from behind T-post 48 such that clip 20 rests on fence wire 50 at bends 26 and 30, and, as best seen in FIG. 7, section 31 surrounds the back side of post 48. As can be seen, apertures 52 and 54 are formed by the interaction of U-shaped sections 25 and 32 and wire 50.

Figure 9:
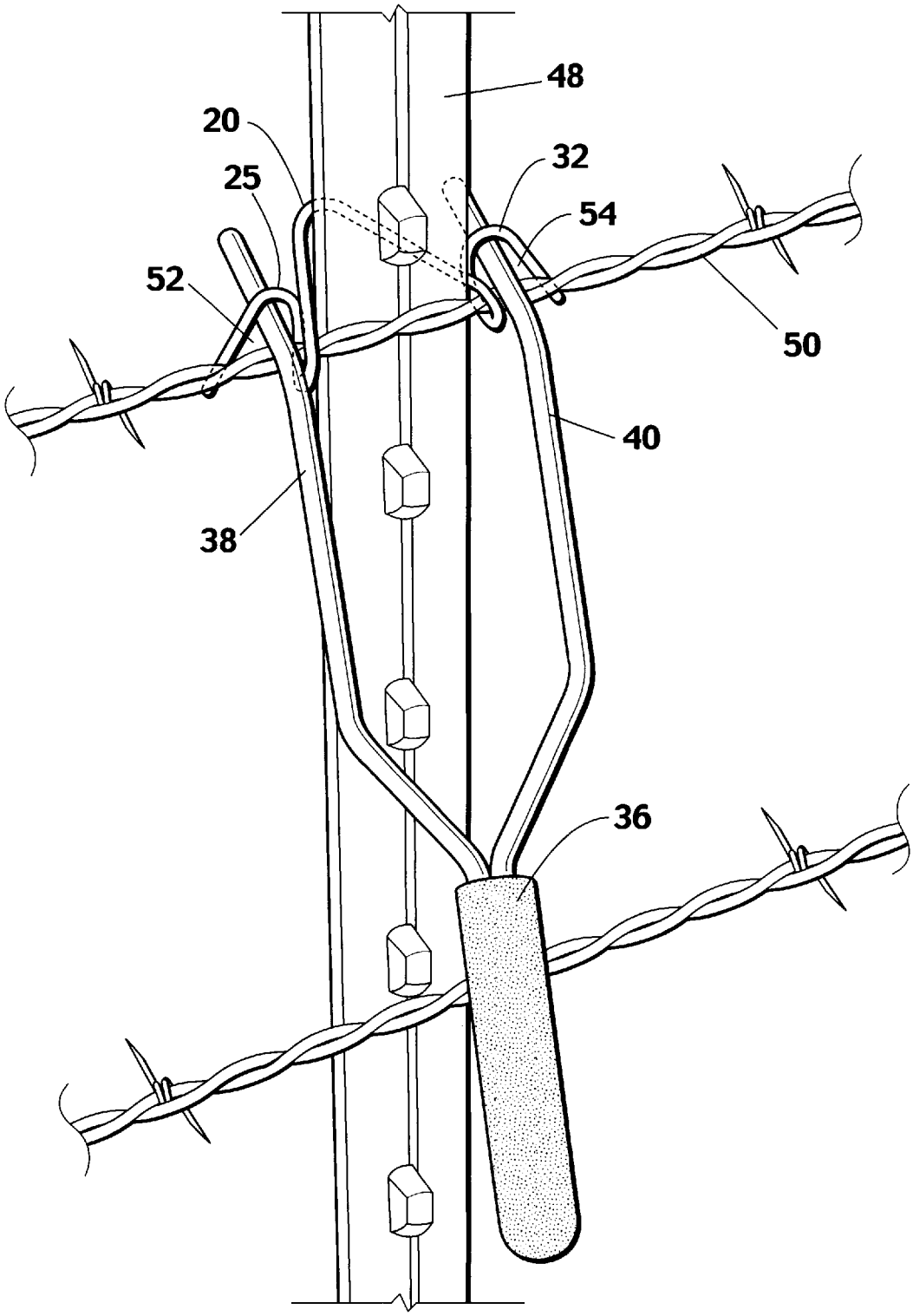
FIG. 9 provides a perspective view of the tool inserted into the clip in a finished position.

Referring next to FIGS. 8 and 9, as previously noted, distal ends 44*a* and 44*b* are spaced such that prongs 38 and 40 are spaced apart a distance roughly equal to the distance between the centers of U-shaped sections 25 and 32. Thus, prongs 38 and 40 may be inserted in to apertures 52 and 54, respectively. To perform the securing operation, the tool 36 is placed in apertures 52 and 54 and rotated downward to wrap clip 20 around wire 50.

Figure 10E:
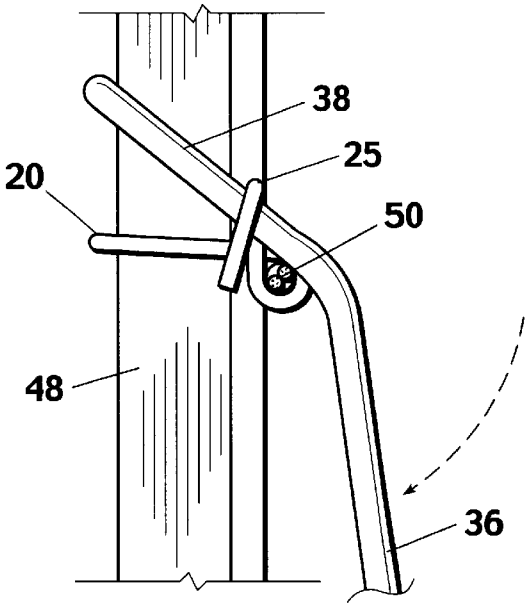
FIG. 10E provides a side view of the T-post, clip, and fence wire with the tool inserted into the clip and rotated to the finished position with the clip fully wrapped around the fence wire.
Figure 10A:
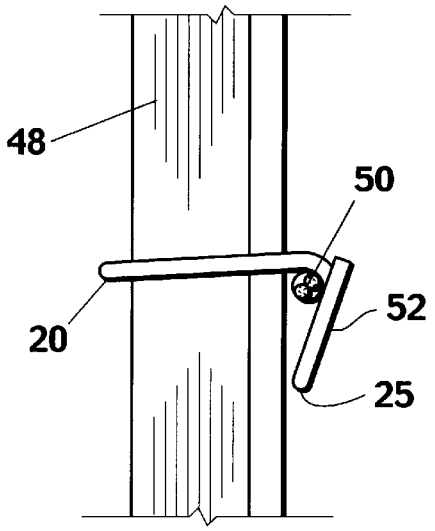
FIG. 10A provides a side view of the T-post, clip, and fence wire as seen from perspective 10A—10A of FIG. 6.
Figure 10B:
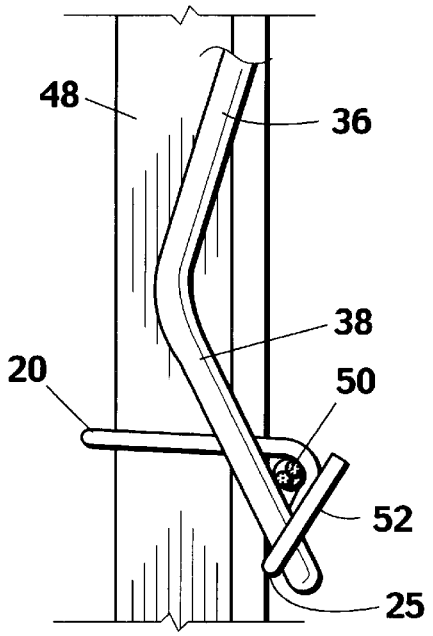
FIG. 10B provides a side view of the T-post, clip, and fence wire with the tool inserted into the clip in an initial position.
Figure 10C:
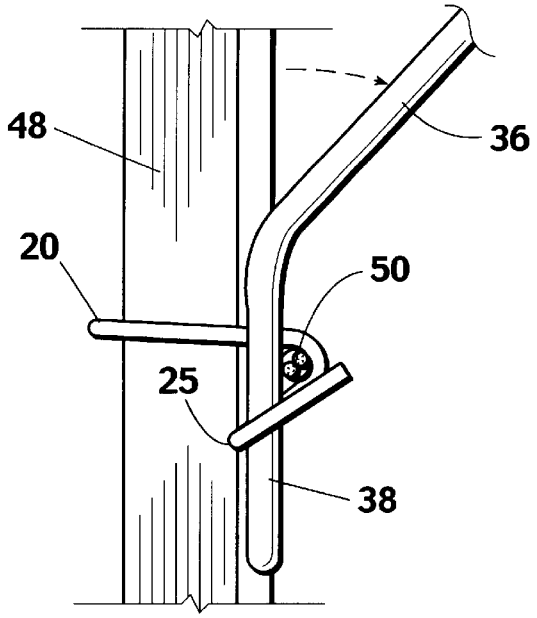
FIG. 10C provides a side view of the T-post, clip, and fence wire with the tool inserted into the clip and rotated to a first intermediate position.
Figure 10D:
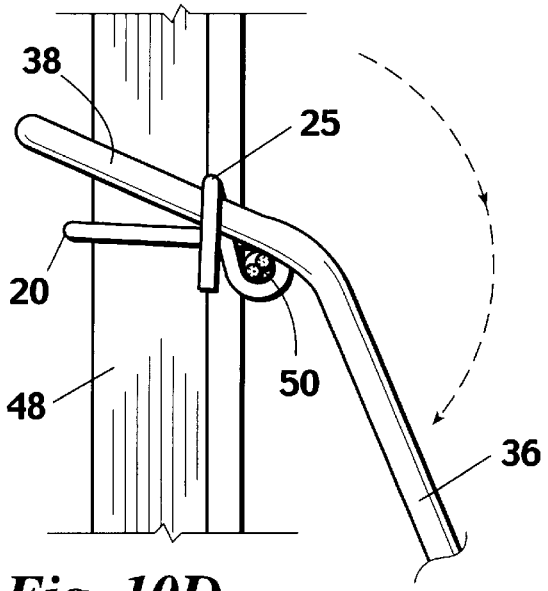
FIG. 10D provides a side view of the T-post, clip, and fence wire with the tool inserted into the clip and rotated to a second intermediate position.

The securing process is shown in generally in FIGS. 8 and 9, and in more detail in FIGS. 10A–10E. Referring first to FIGS. 8 and 10A, clip 20 is placed around post 48 and over wire 50. Referring next to FIG. 10B and continuing with FIG. 8, from the wire side of post 48, prongs 38 and 40 are inserted in apertures 52 and 54, respectively, from the post side of fence wire 50, placing tool 36 in an initial position. Referring to FIGS. 9 and 10C, tool 36 is then rotated downward (clockwise as shown in FIGS. 10A–E). It should be noted that, as the handle 42 is rotated downward, prongs 38 and 40 pivot about fence wire 50, pushing rearward on bends 25 and 32 of clip 20 causing clip 20 to wrap around wire 50 on both sides of post 48. Referring to FIG. 10D and continuing with FIG. 9, as the downward rotation of tool 36 continues, prongs 38 and 40 continue to pivot about fence wire 50 and the wrapping of clip 20 around wire 50 continues. Finally, as shown in FIG. 10E, the tool is moved to its fully downward position and wire 50 is secured to post 48 by a full wrap of clip 20 on each side of post 48. Tool 36 may then be removed from clip 20 and the fence wire 50 is secured to post 48.

An added benefit of the inventive clip 20 over prior art clips is the ease with which a clip may be removed. By reversing the operation described above, inserting the tool into a secured clip from below the wire and rotating the handle upward, clip 20 may be unwrapped from around wire 62 allowing easy removal, when necessary for a repair or when the fence is removed. This feature of the inventive system is particularly useful for temporary fencing.

It should likewise be noted that, while the inventive clip and tool are shown in the figures as used on a barbed wire fence, the invention is not so limited. In fact, in contrast to prior art systems, the inventive system has equal utility with virtually any type of wire fencing. Furthermore, while the inventive device has been discussed relative to its use with T-posts, the invention is likewise not so limited. The inventive clip and tool could be used with round posts, rectangular posts, irregular shaped posts, etc. It should be noted that, for a post of any given width, a clip will be formed such that the width between the outer U-shaped sections will be grater than the width of the post. It will be apparent that a tool for use with any particular clip would thus have a spacing between the prongs of sufficient width to also accommodate the post. In addition, the use of the inventive tool and clip is not limited to agricultural applications. The inventive system may be used for residential fencing, industrial fencing, or any other fencing application.

As will be apparent to those skilled in the art, it is not necessary to use the inventive tool to wrap the ends of the clip around a fence wire. While not as efficient in operation as the inventive tool, a simple screw driver may be used to wrap one end at a time of the clip. The screwdriver is inserted first in either aperture 52 or 54 from behind the wire. Using the fence wire 50 as a fulcrum, the screw driver is then rotated about the fence wire 50 to wrap one end of the clip 20 about the wire. The process is then repeated for the other end of the clip 20. However, unlike the inventive tool 36, any type of straight tool, such as a screwdriver, will require the handle of the tool to pass between parallel horizontal wires of the fence, thus limiting the utility of the clip and tool to only certain types of fencing.

Finally, it should be noted that, unlike prior art clips normally supplied with T-posts, the inventive clip is symmetric about its center axis when viewed from the front or rear of a post. This feature, in particular, facilitates the use of a relatively simple tool to simultaneously wrap both ends of the clip.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A system for securing fencing material to a post comprising:

a clip formed from a single piece of wire including:

a first U-shaped section, said first U-shaped section beginning at a first end of said wire;

a second U-shaped section, said second U-shaped section beginning at a second end of said wire opposite said first end; and a concave section formed between said first U-shaped section and said second U-shaped section, wherein said first U-shaped section and said second U-shaped section lie in a first plane and said concave section lies in a second plane and the angle between said first plane and said second plane is acute, and wherein said first end and said second end terminate above the fence wire when the clip is placed around a fence post and over the fence wire.

2. The system for securing fencing material to a post of claim 1 further comprising:

a tool including:

a handle;

a first prong extending from said handle, said first prong having a first tip; and a second prong extending from said handle, said second prong having a second tip, wherein said first tip and said second tip are spaced apart such that said first tip and said second tip are receivable through said first U-shaped section and said second U-shaped section to engage said first U-shaped section and said second U-shaped section such that, as said tool is rotated about the fence wire, said first prong and said second prong pivot from the fence wire to secure the wire to the post.

3. A method for securing a fence wire to a post using the system of claim 2 including the steps of:

(a) placing said clip over the fence wire and around a post;

(b) engaging said clip with said tool by inserting the first tip through the first U-shaped section and inserting the second tip through the second U-shaped section; and (c) wrapping said clip around the fence wire simultaneously on opposite sides of the post by rotating said tool around the fence wire.

4. A method for forming a fencing clip from a malleable wire including the steps of:

(a) from a first end of the wire, bending first a U-shaped section, said first U-shaped section lying in a first plane and having:

a first leg including said first end;

a second leg; and a rear face;

(b) bending the wire extending from said second leg toward said rear face to form a first acute angle respective to said second leg said first acute angle being formed at a location such that said first leg is longer than said second leg;

(c) bending the wire to form a concave section lying in a second plane, the angle between said first plane and said second plane being defined by said first acute angle;

(d) bending the wire to form a third leg extending substantially parallel to said second leg and lying in said first plane; and (e) bending a second U-shaped section, said second U-shaped section including said third leg and a fourth leg terminating at a second end of the wire opposite said first end, said second U-shaped section being substantially a mirror image of said first U-shaped section and lying in said first plane.

* * * * *